United States Patent [19]

Hashimoto et al.

[11] Patent Number: 4,968,363

[45] Date of Patent: Nov. 6, 1990

[54] METHOD OF PREVENTING CORROSION OF A MATERIAL AGAINST HYDROCHLORIC ACID

[75] Inventors: Koji Hashimoto, 25-5, Shougen 2-Chome, Izumi-Shi, Miyagi; Kazuo Shimamura, Ichihara; Asahi Kawashima; Katsuhiko Asami, both of Sendai, all, Japan

[73] Assignees: Mitsui Engineering & Shipbuilding Co., Ltd., Tokyo; Koji Hashimoto, Miyagi, both of Japan

[21] Appl. No.: 275,642

[22] Filed: Nov. 22, 1988

Related U.S. Application Data

[63] Continuation of Ser. No. 844,902, Mar. 27, 1986, abandoned.

[30] Foreign Application Priority Data

Aug. 6, 1985 [JP] Japan ..... 60-172860
Aug. 6, 1985 [JP] Japan ..... 60-172861

[51] Int. Cl.[5] ..... C22C 19/00

[52] U.S. Cl. ..... 148/403; 148/442

[58] Field of Search ..... 148/403, 320, 325, 327, 148/333, 336, 337, 421, 422, 423, 425–427, 442

[56] References Cited

U.S. PATENT DOCUMENTS 3,856,513 12/1974 Chen et al. ..... 148/403
4,623,387 11/1986 Masumoto et al. ..... 148/403

FOREIGN PATENT DOCUMENTS 0036892 10/1981 European Pat. Off. .
0105137 4/1984 European Pat. Off. .
2500846 10/1975 Fed. Rep. of Germany .
2534379 2/1976 Fed. Rep. of Germany .
3146031 7/1982 Fed. Rep. of Germany .

*Primary Examiner*—R. Dean
*Attorney, Agent, or Firm*—Kanesaka and Takeuchi

[57] ABSTRACT

A highly corrosion-resistant amorphous alloy composed of ni— 15–80 atomic % Ta Ni— 30–80 atomic % Ta, or Ni— 20–50 atomic % Ta— 10–23 atomic % P, with a specific amount of optional elements of Ti, Zr, Nb, W, Fe, Co, Cr, P, B, Si, or C.

41 Claims, 1 Drawing Sheet

METHOD OF PREVENTING CORROSION OF A MATERIAL AGAINST HYDROCHLORIC ACID

This application is a continuation of application Ser. No. 844,902, filed Mar. 27, 1986, abandoned.

FIELD OF THE INVENTION AND RELATED ART STATEMENT

The present invention relates to a highly corrosion-resistant amorphous alloy which withstands a severe corrosive environment such as boiling conc. hydrochloric acid.

Heretofore, tantalum has been only a metallic material that can be used in boiling conc. hydrochloric acid. In such a severe corrosive environment, even tantalum unavoidably corrodes at a rate of about 50 μm/year and suffers hydrogen embrittlement cracking.

In view of the above-foregoing, there has been a strong demand for a new metallic material which can be used in very aggressive environments.

SUMMARY OF THE INVENTION

It is an object of the present invention to provide a highly corrosion-resistant amorphous alloy which withstands a severe environment such as boiling conc. hydrochloric acid which is nonoxidizing and almost incapable of passivating a metal, and yet is highly corrosive.

The object of the invention is achieved by an amorphous alloy of specific composition containing Ta and Ni as essential components.

According to the present invention, the following alloys are provided.

(1) A highly corrosion-resistant amorphous alloy which comprises 30 to 80 atomic % of Ta, with the balance being substantially Ni.

(2) A highly corrosion-resistant amorphous alloy which comprises 12 atomic % or more Ta and 30 to 80 atomic % in total of Ta and Nb, with the balance being substantially Ni.

(3) A highly corrosion-resistant amorphous alloy which comprises 25 atomic % or more Ta and 30 to 80 atomic % in total of Ta and one or more elements selected from the group consisting of Ti, Zr, and Cr, with the balance being substantially Ni.

(4) A highly corrosion-resistant amorphous alloy which comprises 12 atomic % or more Ta, 25 atomic % or more in total of Ta and Nb, and 30 to 80 atomic % in total of Ta, Nb, and one or more elements selected from the group consisting of Ti, Zr, and Cr, with the balance being substantially Ni.

(5) A highly corrosion-resistant amorphous alloy which comprises 30 to 80 atomic % of Ta and 2 atomic % or more Ni, with the balance being substantially either or both of Fe and Co, and the total amount being 100 atomic %.

(6) A highly corrosion-resistant amorphous alloy which comprises 12 atomic % or more Ta, 30 to 80 atomic % in total of Ta and Nb, and 2 atomic % or more Ni, with the balance being substantially either or both of Fe and Co, and the total amount being 100 atomic %.

(7) A highly corrosion-resistant amorphous alloy which comprises 25 atomic % or more Ta, 30 to 80 atomic % in total of Ta and one or more elements selected from the group consisting of Ti, Zr, and Cr, and 2 atomic % or more Ni, with the balance being substantially either or both of Fe and Co, and the total amount being 100 atomic %.

(8) A highly corrosion-resistant amorphous alloy which comprises 12 atomic % or more Ta, 25 atomic % in total of Ta and Nb, 30 to 80 atomic % in total of Ta, Nb, and one or more elements selected from the group consisting of Ti, Zr, and Cr, and 2 atomic % or more Ni, with the balance being substantially either or both of Fe and Co, and the total amount being 100 atomic %.

(9) A highly corrosion-resistant amorphous alloy which comprises 20 atomic % or more but less than 80 atomic % of Ta and 7 atomic % or less P, with the balance being substantially 20 atomic % or more Ni, and the total amount being 100 atomic %.

(10) A highly corrosion-resistant amorphous alloy which comprises 7 atomic % or more Ta, 20 atomic % or more but less than 80 atomic % in total of Ta and Nb, and 7 atomic % or less P, with the balance being substantially 20 atomic % or more Ni, and the total amount being 100 atomic %.

(11) A highly corrosion-resistant amorphous alloy which comprises 15 atomic % or more Ta, 20 atomic % or more but less than 80 atomic % in total of Ta and one or more elements selected from the group consisting of Ti, Zr, and Cr, and 7 atomic % or less P, with the balance being substantially 20 atomic % or more Ni, and the total amount being 100 atomic %.

(12) A highly corrosion-resistant amorphous alloy which comprises 7 atomic % or more Ta, 16 atomic % or more in total of Ta and Nb, 20 atomic % or more but less than 80 atomic % in total of Ta, Nb, and one or more elements selected from the group consisting of Ti, Zr, and Cr, and 7 atomic % or less P, with the balance being substantially 20 atomic % or more Ni, and the total amount being 100 atomic %.

(13) A highly corrosion-resistant amorphous alloy which comprises 20 atomic % or more but less than 80 atomic % of Ta, 2 atomic % or more Ni, 7 atomic % or less P, and 20 atomic % or more in total of Ni and either or both of Fe and Co which are substantially the balance, with the total amount being 100 atomic %.

(14) A highly corrosion-resistant amorphous alloy which comprises 7 atomic % or more Ta, 20 atomic % or more but less than 80 atomic % in total of Ta and Nb, 2 atomic % or more Ni, and 7 atomic % or less P, and 20 atomic % or more in total of Ni and either or both of Fe and Co which are substantially the balance, with the total amount being 100 atomic %.

(15) A highly corrosion-resistant amorphous alloy which comprises 15 atomic % or more Ta, 20 atomic % or more but less than 80 atomic % in total of Ta and one or more elements selected from the group consisting of Ti, Zr, and Cr, 2 atomic % or more Ni, and 7 atomic % or less P, and 20 atomic % or more in total of Ni and either or both of Fe and Co which are substantially the balance, with the total amount being 100 atomic %.

(16) A highly corrosion-resistant amorphous alloy which comprises 7 atomic % or more Ta, 16 atomic % or more in total of Ta and Nb, 20 atomic % or more but less than 80 atomic % in total of Ta, Nb, and one or more elements selected from the group consisting of Ti, Zr, and Cr, 2 atomic % or more Ni, and 7 atomic % or less P, and 20 atomic % or more in total of Ni and either or both of Fe and Co which are substantially the balance, with the total amount being 100 atomic %.

(17) A highly corrosion-resistant amorphous alloy which comprises 20 to 50 atomic % of Ta and 10 to 23 atomic % of P, with the balance being substantially Ni.

(18) A highly corrosion-resistant amorphous alloy which comprises 7 atomic % or more Ta, 20 to 50 atomic % in total of Ta and Nb, and 10 to 23 atomic % of P, with the balance being substantially Ni.

(19) A highly corrosion-resistant amorphous alloy which comprises 15 atomic % or more Ta, 20 to 50 atomic % in total of Ta and one or more elements selected from the group consisting of Ti, Zr, and Cr, and 10 to 23 atomic % of P, with the balance being substantially Ni.

(20) A highly corrosion-resistant amorphous alloy which comprises 8 atomic % or more Ta, 16 atomic % or more in total of Ta and Nb, 20 to 50 atomic % in total of Ta, Nb, and one or more elements selected from the group consisting of Ti, Zr, and Cr, and 10 to 23 atomic % of P, with the balance being substantially Ni.

(21) A highly corrosion-resistant amorphous alloy which comprises 20 to 50 atomic % of Ta, 10 to 23 atomic % of P, and 2 atomic % or more Ni, with the balance being substantially either or both of Fe and Co, and the total amount being 100 atomic %.

(22) A highly corrosion-resistant amorphous alloy which comprises 7 atomic % or more Ta, 20 to 50 atomic % in total of Ta and Nb, 10 to 23 atomic % of P, and 2 atomic % or more Ni, with the balance being substantially either or both of Fe and Co, and the total amount being 100 atomic %.

(23) A highly corrosion-resistant amorphous alloy which comprises 15 atomic % or more Ta, 20 to 50 atomic % in total of Ta and one or more elements selected from the group consisting of Ti, Zr, and Cr, 10 to 23 atomic % of P, and 2 atomic % or more Ni, with the balance being substantially either or both of Fe and Co, and the total amount being 100 atomic %.

(24) A highly corrosion-resistant amorphous alloy which comprises 8 atomic % or more Ta, 16 atomic % or more in total of Ta and Nb, 20 to 50 atomic % in total of Ta, Nb, and one or more elements selected from the group consisting of Ti, Zr, and Cr, 10 to 23 atomic % of P, and 2 atomic % or more Ni, with the balance being substantially either or both of Fe and Co, and the total amount being 100 atomic %.

(25) A highly corrosion-resistant amorphous alloy which comprises 20 to 50 atomic % of Ta, 0.05 atomic % or more P, and 10 to 23 atomic % in total of P and one or more elements selected from the group consisting of B, Si, and C, with the balance being substantially Ni.

(26) A highly corrosion-resistant amorphous alloy which comprises 7 atomic % or more Ta, 0.05 atomic % or more P, 20 to 50 atomic % in total of Ta and Nb, and 10 to 23 atomic % in total of P and one or more elements selected from the group consisting of B, Si, and C, with the balance being substantially Ni.

(27) A highly corrosion-resistant amorphous alloy which comprises 15 atomic % or more Ta, 0.05 atomic % or more P, 20 to 50 atomic % in total of Ta and one or more elements selected from the group consisting of Ti, Zr, and Cr, and 10 to 23 atomic % in total of P and one or more elements selected from the group consisting of B, Si, and C, with the balance being substantially Ni.

(28) A highly corrosion-resistant amorphous alloy which comprises 8 atomic % or more Ta, 0.05 atomic % or more P, 16 atomic % or more in total of Ta and Nb, 20 to 50 atomic % in total of Ta, Nb, and one or more elements selected from the group consisting of Ti, Zr, and Cr, and 10 to 23 atomic % in total of P and one or more elements selected from the group consisting of B, Si, and C, with the balance being substantially Ni.

(29) A highly corrosion-resistant amorphous alloy which comprises 20 to 50 atomic % of Ta, 0.05 atomic % or more P, 2 atomic % or more Ni, and 10 to 23 atomic % in total of P and one or more elements selected from the group consisting of B, Si, and C, with the balance being substantially either or both of Fe and Co, and the total amount being 100 atomic %.

(30) A highly corrosion-resistant amorphous alloy which comprises 7 atomic % or more Ta, 0.05 atomic % or more P, 2 atomic % or more Ni, 20 to 50 atomic % in total of Ta and Nb, and 10 to 23 atomic % in total of P and one or more elements selected from the group consisting of B, Si, and C, with the balance being substantially either or both of Fe and Co, and the total amount being 100 atomic %.

(31) A highly corrosion-resistant amorphous alloy which comprises 15 atomic % or more Ta, 0.05 atomic % or more P, 2 atomic % or more Ni, 20 to 50 atomic % in total of Ta and one or more elements selected from the group consisting of Ti, Zr, and Cr, and 10 to 23 atomic % in total of P and one or more elements selected from the group consisting of B, Si, and C, with the balance being substantially either or both of Fe and Co, and the total amount being 100 atomic %.

(32) A highly corrosion-resistant amorphous alloy which comprises 8 atomic % or more Ta, 0.05 atomic % or more P, 2 atomic % or more Ni, 16 atomic % or more in total of Ta and Nb, 20 to 50 atomic % in total of Ta, Nb, and one or more elements selected from the group consisting of Ti, Zr, and Cr, and 10 to 23 atomic % in total of P and one or more elements selected from the group consisting of B, Si, and C, with the balance being substantially either or both of Fe and Co, and the total amount being 100 atomic %.

DESCRIPTION OF THE PREFERRED EMBODIMENTS

Figure 1:
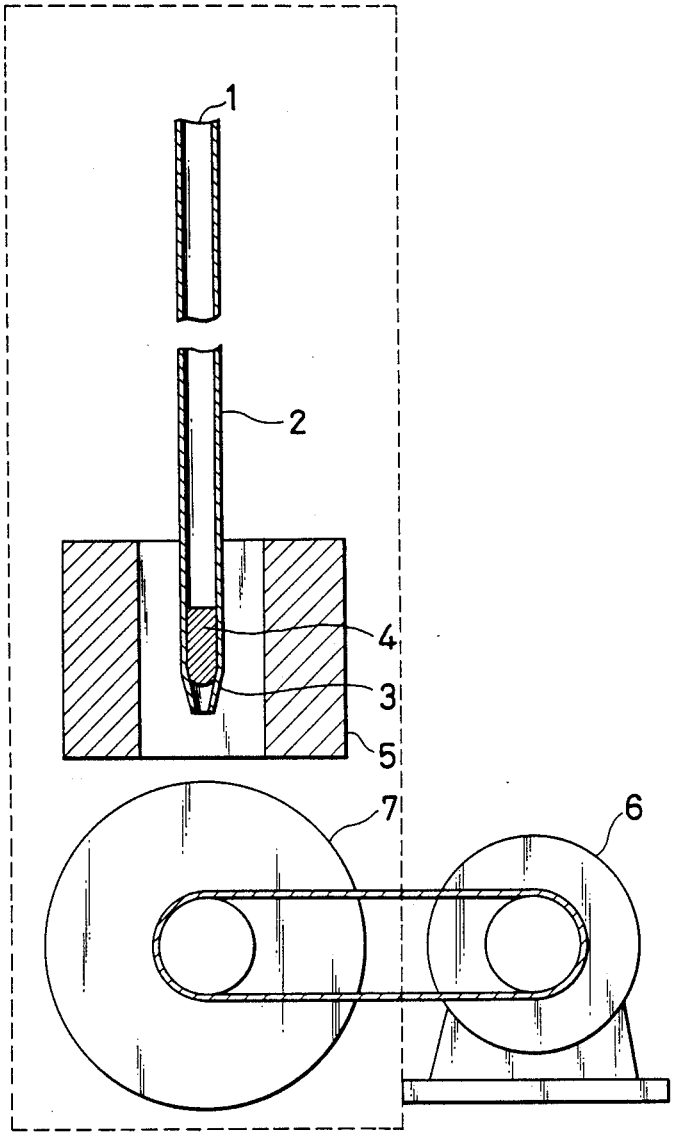
FIG. 1 shows an apparatus for preparing an alloy of the present invention.

It is generally known that an alloy has a crystalline structure in the solid state. However, an alloy having a specific composition becomes amorphous by prevention of the formation of long-range order structure during solidification through, for example, rapid solidification from the liquid state, sputter deposition or plating under the specific conditions; or by destruction of the long-range order structure of the solid alloy through ion implantation which is also effective for supersaturation with necessary elements. The amorphous alloy thus formed is an extremely homogeneous solid solution containing sufficient amounts of various alloying elements beneficial in providing specific characteristics.

The present inventors carried out a series of researches paying their attention to the outstanding properties of amorphous alloys. As the result, they found that it is possible to produce a highly corrosion-resistant amorphous alloy which withstands hot conc. nitric acid which may contain even oxidizing agents. On the basis of this finding, they filed a patent application. (Japanese Patent Application No. 51036/1985). The amorphous alloys covered by this patent application are as follows:

(1) A highly corrosion-resistant amorphous alloy which comprises 15 to 80 atomic % of Ta, with the balance being substantially Ni.

(2) A highly corrosion-resistant amorphous alloy which comprises one or more elements selected from the group consisting of Ti, Zr, Nb, and W, wherein the content of Ta is 10 atomic % or more and the total content of Ta and said one or more elements selected from said group is 15 to 80 atomic %.

(3) A highly corrosion-resistant amorphous alloy which comprises Ta and Fe and/or Co, with the balance substantially Ni, wherein the content of Ta is 15 to 80 atomic %, the content of Fe and/or Co is 75 atomic % or less, and the content of Ni is 7 atomic % or more.

(4) A highly corrosion-resistant alloy which comprises Ta, one or more elements selected from the group consisting of Ti, Zr, Nb, and W, and Fe and/or Co, with the balance substantially being Ni, wherein the content of Ta is 10 atomic % or more, the total content of Ta and said one or more elements selected from said group is 15 to 80 atomic %, the content of Fe and/or Co is 75 atomic % or less, and the content of Ni is 7 atomic % or more.

Because of high oxidizing power of hot concentrated nitric acids regardless of the presence or absence of oxidizing agents, the above-mentioned amorphous alloys become spontaneously passivated, forming a protective passive film, and exhibit high corrosion resistance. In contrast hot concentrated hydrochloric acids have a poor oxidizing power, and hence spontaneous passivation hardly occurs unless the alloy has a very high passivating ability. The present inventors continued to study the properties of amorphous alloys, and found that the alloys which have a particularly high passivating ability among those disclosed in the above-mentioned Japanese Patent Application No. 51036/1985, or other alloys which further contain alloying elements enhancing the passivating ability form a passive film even in very aggressive concentrated hydrochloric acid without having a oxidizing power. These findings led to the present invention which covers the alloys set forth in embodiments 1 to 16 and embodiments 17 to 32.

Tables 1 and 2 show the components and compositions of the alloys set forth in embodiments 1 to 32.

TABLE 1

(atomic %)

| Embodiment No. | Ta | Nb | Ti, Zr, Cr (*1) | P | Ni | Fe, Co (*2) |
|---|---|---|---|---|---|---|
| 1 | 30–80 | | | | Balance | |
| 2 | 12 or more | 30–80 with Ta | | | Balance | |
| 3 | 25 or more | | 30–80 with Ta, Nb | | Balance | |
| 4 | 12 or more | 25 and up with Ta | 30–80 with Ta, Nb | | Balance | |
| 5 | 30–80 | | | | 2 or more | Balance |
| 6 | 12 or more | 30–80 with Ta | | | 2 or more | Balance |
| 7 | 25 or more | | 30–80 with Ta | | 2 or more | Balance |
| 8 | 12 or more | 25 up with Ta | 30–80 with Ta, Nb | | 2 or more | Balance |
| 9 | 20 or more and less than 80 | | | 7 or less | Balance (20 and up) | |
| 10 | 7 or more | 20 or more and less than 80 with Ta | | 7 or less | Balance (20 and up) | |
| 11 | 15 or more | | 20 or more and less than 80 with Ta | 7 or less | Balance (20 and up) | |
| 12 | 7 or more 16 up with Ta | | 20 or more and less than 80 with Ta, Nb | 7 or less | Balance (20 and up) | |
| 13 | 20 or more and less than 80 | | | 7 or less | 2 or more | Balance (20 or more with Ni) |
| 14 | 7 or more | 20 or more and less than 80 with Ta | | 7 or less | 2 or more | Balance (20 or more with Ni) |
| 15 | 15 or more | | 20 or more and less than 80 with Ta | 7 or more | 2 or more | Balance (20 or more with Ni) |
| 16 | 7 or more | 16 and up with Ta | 20 or more and less than 80 with Ta, Nb | 7 or more | 2 or more | Balance (20 or more with Ni) |

(*1): One or more of Ti, Zr, and Cr.

TABLE 2

(atomic %)

| Embodiment No. | Ta | Nb | Ti, Zr, Cr (*1) | P | B, Si, C (*2) | Ni | Fe, Co (*3) |
|---|---|---|---|---|---|---|---|
| 17 | 20–50 | | | 10–23 | | Balance | |
| 18 | 7 or more | 20–50 with Ta | | 10–23 | | Balance | |
| 19 | 15 or more | | 20–50 with Ta | 10–23 | | Balance | |
| 20 | 8 or more | 16 or more with Ta | 20–50 with Ta, Nb | 10–23 | | Balance | |
| 21 | 20–50 | | | 10–23 | | 2 or more | Balance |
| 22 | 7 or more | 20–50 with Ta | | 10–23 | | 2 or more | Balance |
| 23 | 15 or more | | 20–50 with Ta | 10–23 | | 2 or more | Balance |
| 24 | 8 or more | 16 or more with Ta | 20–50 with Ta, Nb | 10–23 | | 2 or more | Balance |
| 25 | 20–50 | | | 0.05 or more | 10–23 with P | Balance | |
| 26 | 7 or more | 20–50 with Ta | | 0.05 or more | 10–23 with P | Balance | |
| 27 | 15 or more | | 20–50 with Ta | 0.05 or more | 10–23 with P | Balance | |
| 28 | 8 or more | 16 or more with Ta | 20–50 with Ta, Nb | 0.05 or more | 10–23 with P | Balance | |
| 29 | 20–50 | | | 0.05 or more | 10–23 with P | 2 or more | Balance |
| 30 | 7 or more | 20–50 with Ta | | 0.05 or more | 10–23 with P | 2 or more | Balance |
| 31 | 15 or more | | 20–50 with Ta | 0.05 or more | 10–23 with P | 2 or more | Balance |

TABLE 2-continued

| Embodiment No. | Ta | Nb | Ti, Zr, Cr (*1) | P | B, Si, C (*2) | Ni | Fe, Co (*3) |
|---|---|---|---|---|---|---|---|
| | | | (atomic %) | | | | |
| 32 | 8 or more | 16 or more with Ta | 20–50 with Ta, Nb | 0.05 or more | 10–23 with P | 2 or more | Balance |

(*1): One or more of Ti, Zr, and Cr.
(*2): One or more of B, Si, and C.
(*3): Either of both of Fe and Co.

The amorphous alloys of this invention are produced by commonly used methods for production of amorphous alloys such as rapid solidification from the liquid state or sputter deposition. They are single-phase alloys in which the alloying elements exist in a state of uniform solid solution. Accordingly, they form an extremely uniform and highly corrosion-resistant protective passive film under the passivating conditions. In general, metallic materials actively dissolve in hot concentrated hydrochloric acid solutions having a poor oxidizing power. Therefore, metallic materials intended for use in such environments should have a strong ability to form spontaneously a stable protective passive film in non-oxidizing environments. This object is achieved by an alloy containing effective elements as much as necessary. However, it is not desirable to add various alloying elements in large quantities to a crystalline metal, because the resulting alloy is of a multiple phase mixture, with each phase having different chemical properties, and is not so satisfactory in corrosion resistance as intended. Moreover, the chemical heterogeneity is rather harmful to corrosion resistance.

In contrast, the amorphous alloys of this invention are of homogeneous solid solution. Therefore, they homogeneously contain effective elements as much as required to form uniformly a stable passive film. Owing to the formation of this uniform passive film, the amorphous alloys of this invention exhibit sufficiently high corrosion resistance.

In other words, metallic materials to withstand hot concentrated hydrochloric acid solutions with a poor oxidizing power should have a very high passivating ability to form spontaneously a uniform, stable passive film in such environments. Alloys of amorphous structure permit a variety of alloying elements to exist in a form of single-phase solid solution. Consequently, the amorphous alloys of the present invention form uniform passive films in very aggressive hot concentrated hydrochloric acids.

The components and composition of the alloys of this invention are specified as above for the following reasons.

The alloys of the present invention are classified into two groups of those set forth in the embodiments 1 to 16 and those set forth in the embodiments 17 to 32. The former alloys become amorphous essentially by the presence of Ni (Fe and Co) and one or more of valve metals such as Ta, Nb, Ti and Zr. The latter alloys are vitrifiable mainly because they contain sufficient amounts of metalloids such as P, B, SI and C. The effects of various elements in two groups of alloys of the present invention are not largely different to some extent, but the specification of components and compositions of alloys in this invention is described separately for these two groups for convenience.

In the alloys set forth in the embodiments 1 to 16, Ni is a basic metal which forms the amorphous structure when it coexists with one or more of valve metals such as Ta, Nb, Ti and Zr. Therefore, the alloys set forth in the embodiments 9 to 12 should contain 20 atomic % or more Ni so that they form the amorphous structure.

Ta is an alloying element that forms a stable passive film in a hot strong acid. In addition, it forms the amorphous structure when it coexists with Ni or Ni with a portion thereof replaced with either or both of Fe and Co. For the alloys set forth in the embodiments 1 and 5, the content of Ta should be 30 atomic % or more to exhibit sufficient corrosion resistance. In the alloys set forth in the embodiments 9 and 13 containing P which enhances passivation, the minimum content of Ta may be lower, and hence the content of Ta should be 20 atomic % or more. Because the amorphous structure is not formed when the total content of Group VIIIa elements (Ni, Fe, and Co) is less than 20 atomic % in Ni (Fe and Co)-valve mental alloys, the Ta content should be 80 atomic % or less in the alloys set forth in the embodiments 1 and 5 and should be less than 80 atomic % in the alloys set forth in the embodiments 9 and 13.

Nb is next to Ta in the passivating ability, and it is an element that forms the amorphous structure when it coexists with Ni. However, the beneficial effect of Nb in enhancing the corrosion resistance is not so large as that of Ta; therefore, Ta cannot be replaced entirely with Nb. In the alloys set forth in the embodiments 2 and 6 in which Ta and Nb form a passive film, the content of Ta should be 12 atomic % or more and the total content of Ta and Nb should be 30 atomic % or more to ensure corrosion resistance. In the alloys set forth in the embodiments 10 and 14, in which P helps the formation of passive films of Ta and Nb, the content of Ta should be 7 atomic % or more and the total content of Ta and Nb should be 20 atomic % or more.

If the total content of Ni, Fe, and Co is less than 20 atomic %, they do not form the amorphous structure even when they coexist with Ta and Nb. Therefore, in the alloys set forth in the embodiments 2 and 6, the total content of Ta and Nb should be 80 atomic % or less, and in the alloys set forth in the embodiments 10 and 14, the total content of Ta and Nb should be less than 80 atomic %.

Ti and Zr are alloying elements which, in place of Ta and Nb, form the amorphous structure in cooperation with Ni. Ti, Zr, and Cr are capable of forming passive films in hot strong acids. The beneficial effects of Ti, Zr, and Cr in enhancing the corrosion resistance are not so large as those of Ta and Nb; therefore, Ta and Nb cannot be replaced entirely with Ti, Zr, and Cr, if corrosion resistance is to be ensured. However, when the content of Ta is 25 atomic % or more as in the alloys set forth in the embodiments 3 and 7, sufficient corrosion resistance is ensured so long as the total content of Ta and one or more of Ti, Zr, and Cr is 30 atomic % or more. When both Ta and Nb are contained, as in the alloys set forth in the embodiments 4 and 8, corrosion resistance is ensured so long as the alloys contain 12 atomic % of more Ta, 25 atomic % or more in total of Ta and Nb, and 30 atomic % or more in total of Ta, Hb and one or more of Ti, Zr and Cr.

In the case of alloys containing P which helps passivation, the minimum content of Ti, Zr, and Cr may be lower. In the alloys set forth in the embodiments 11 and 15, in which the content of Ta is 15 atomic % or more, corrosion resistance is ensured so long as the total content of Ta and one or more of Ti, Zr, and Cr is 20 atomic % or more. In the case of alloys containing Ta, Nb, and P, as in the alloys set forth in the embodiments 12 and 16, corrosion resistance is ensured so long as the alloys contain 7 atomic % or more Ta, 16 atomic % or more in total of Ta and Nb, and 20 atomic % or more in total of Ta, Nb, and one or more of Ti, Zr, and Cr. If the total content of Ni, Fe, and Co is less than 20 atomic %, they do not form the amorphous structure even when they coexist with Ta, Nb, Ti, Zr, and Cr; therefore, in the alloys set forth in the embodiments 3 and 7, the total content of Ta and one or more of Ti, Zr, and Cr should be 80 atomic % or less; in the alloys set forth in the embodiments 4 and 8, the total content of Ta, Nb, and one or more of Ti, Zr, and Cr should be 80 atomic % or less; in the alloys set forth in the embodiments 11 and 15, the total content of Ta and one or more of Ti, Zr, and Cr should be less than 80 atomic %; and in the alloys set forth in the embodiments 12 and 16, the total content of Ta, Nb, and one or more of Ti, Zr, and Cr should be less than 80 atomic %.

P does not constitute a passive film, but greatly accelerates the formation of a passive film of Ta, Nb, Ti, Zr, and Cr. The beneficial effect of P is remarkable even by the addition of a very small amount of P. In the amorphous Ni (Fe and Co)-valve metal alloys of this invention, the content of P should be 7 atomic % or less, because an excess amount of the P in addition to the Ni (Fe and Co)-Valve metal alloys prevents the formation of amorphous structure.

Fe and Co are alloying elements which, in place of Ni, form the amorphous structure in cooperation with Ta, Nb, Ti, and Zr. If either or both of Fe and Co are substituted for Ni to such an extent that the content of Ni is less than 2 atomic %, the formation of the amorphous structure becomes difficult. If the total content of 2 atomic % or more Ni and either or both of Fe and Co is less than 20 atomic %, the formation of the amorphous structure becomes difficult. Therefore, in the alloys set forth in the embodiments 5 to 8 and the embodiments 13 to 16, the content of Ni should be 2 atomic % or more. In the alloys set forth in the embodiments 13 to 16, the total content of 2 atomic % or more Ni and either or both of Fe and Co should be 20 atomic % or more.

The amorphous alloys set forth in the embodiments 1 to 16 may contain 3 atomic % or less V and Mo, and 20 atomic % or less Hf without any adverse effect on the object of this invention. On the other hand, metalloids such as B, Si, and C are known to be elements that effectively form the amorphous structure. However, an amorphous alloy containing large amounts of B, Si and C does not form a stable passive film in hot strong acids. Therefore, they are not necessarily effective in this invention. Nevertheless, these metalloids replacing a portion of P do not adversely affect corrosion resistance but help the formation of the amorphous structure.

In the alloys set forth in the embodiments 17 to 32, Ni is a basic metal which forms the amorphous structure when it coexists with a metalloid such as P, B, Si, and C. It also assists the actions of Ta, Nb, Ti, and Cr which are responsible for corrosion resistance. On the other hand, Fe and Co are the alloying elements which, together with Ni, form the amorphous structure in cooperation with a metalloid. In order to ensure the corrosion resistance based on the presence of alloying elements Ta, Nb, Ti, Zr, and Cr in very aggressive environments such as boiling conc. hydrochloric acids, either or both of Fe and Co cannot be replaced entirely with Ni. Therefore, in the alloys containing either or both of Fe and Co set forth in the embodiments 21 to 24 and the embodiments 29 to 32, the content of Ni should be 2 atomic % or more.

P is an alloying element that forms the amorphous structure in cooperation with Ni, Fe, and Co. P does not constitute a passive film by itself, but greatly accelerates the formation of a passive film of Ta, Nb, Ti, Zr, and Cr. In the alloys set forth in the embodiments 17 to 24, the content of P should be 10 to 23 atomic % for the formation of the amorphous structure. On the other hand, B, Si, and Ni, Fe, and Co, but their beneficial effect in accelerating the formation of a passive state film of Ta, Nb, Ti, Zr and Cr is not so large as that of P. Hence, in the alloys set forth in the embodiments 25 to 32, the content of P should be 0.05 or more for the acceleration of the passive film formation. In addition, for the formation of amorphous structure, the total content of 0.05 atomic % or more P and one or more of B, Si, and C should be 10 to 23 atomic %.

Ta, Nb, Ti, Zr, and Cr are alloying elements that form passive films in hot conc. hydrochloric acids. Ta is most effective among them. In the alloys set forth in the embodiments 17, 21, 25 and 29, in which a passive film is formed by Ta alone, the content of Ta should be 20 atomic % or more.

Nb has a high passivating ability but the beneficial effect of Nb in enhancing the corrosion resistance is not so large as that of Ta. Therefore, Ta cannot be replaced entirely with Nb. In the alloys set forth in the embodiments 18, 22, 26 and 30, the content of Ta should be 7 atomic % or more and the total content of Ta and Nb should be 20 atomic % or more for sufficient corrosion resistance.

The beneficial effects of Ti, Zr, and Cr in enhancing the corrosion resistance are not so large as those of Ta and Nb. Therefore, Ta and Nb cannot be replaced entirely with one or more of Ti, Zr, and Cr. However, in the case of the alloys set forth in the embodiments 19, 23, 27, and 31, which contain 15 atomic % or more Ta, the total content of Ta and one or more of Ti, Zr, and Cr should be 20 atomic % or more for sufficient corrosion resistance. In the case of the alloys set forth in the embodiments 20, 24, 28, and 32, in which the content of Ta is 7 atomic % or more and the total content of Ta and Nb is 16 atomic % or more, the total content of Ta and Nb and one or more of Ti, Zr, and Cr should be 20 atomic % or more for sufficient corrosion resistance.

In the amorphous alloys set forth in the embodiments 17 to 32, the combination of Ni (Fe and Co) and metalloids ensures the formation of the amorphous structure. When Ni, Fe, and Co in the alloy system are partly replaced with Ta, Nb, Ti, Zr, and Cr, the total amounts of Ta, Nb, Ti, Zr and Cr should be 50 atomic % or less, so that the formation of the amorphous structure is ensured.

The amorphous alloys set forth in the embodiments 17 to 32 may contain 10 atomic % or less V and Mo, and 20 atomic % or less Hf without any adverse effect on the object of this invention.

The amorphous alloy of this invention forms a stable passive film and resists corrosion in severe corrosive environments such as boiling conc. hydrochloric acids having a poor oxidizing power.

The amorphous alloys of this invention can be produced by using any of the existing methods for the production of amorphous alloys such as rapid solidification of molten alloys, formation of amorphous structure through gas phase, and ion implantation that destroys the long-range order of the solid. Therefore, they can be produced with the existing apparatus, and consequently they are of practical value.

A suitable preparation method of amorphous alloys of the present invention is as follows:

The amorphous alloys with compositions mentioned above can be prepared by rapid quenching from the liquid state at a cooling rate of higher than 10,000° C./sec. If the cooling rate is slower than 10,000° C./sec., it is difficult to form completely amorphous alloys. In principle, the amorphous alloys of the present invention can be produced by any suitable apparatus provided with a cooling rate higher than 10,000° C./sec.

One embodiment of apparatus for preparing the amorphous alloys of the present invention is shown in FIG. 1. The apparatus is placed in a vacuum chamber indicated by a dotted rectangle. In the figure, a quartz tube (2) has a nozzle (3) at its lower end in the vertical direction, and raw materials (4) and an inert gas for a jet of the raw materials melted are fed from the inlet (1). A heater (5) is placed around the quartz tube (2) so as to heat the raw materials (4). A high speed wheel (7) is placed below the nozzle (3) and is rotated by a motor (6).

The apparatus is previously evacuated up to about $10^{-5}$ torr and then exposed to an inert gas atmosphere such as argon or nitrogen. The raw materials (4) having the specific compositions required are melted by the heater (5) in the quartz tube under an inert gas atmosphere. The molten alloys impinge under the pressure of the inert gas of 0.4–2 kg/cm$^2$ onto the outer surface of the wheel (7) which is rotated at a speed of 1,000 to 10,000 rpm whereby the amorphous alloys are formed as long thin plates, which may for example have thicknesses of 0.01–0.1 mm, widths of 1–10 mm and lengths of several to several tens of meters.

The invention is now illustrated by the following examples.

EXAMPLE 1

A variety of alloy ingots were cast by argon arc melting of commercial metals and home-made nickel phosphide.

The cast alloys were remelted in an argon atmosphere and the molten alloys were rapidly solidified by the rotating wheel method shown in FIG. 1 to form ribbon-shaped amorphous alloys 0.01 to 0.05 mm thick, 1 to 3 mm wide, and 3 to 20 m long. The nominal compositions of alloys are given in Table 3.

The formation of the amorphous structure was confirmed by X-ray diffractometry. Typical ones of the alloy samples were polished with silicon carbide paper up to #1000 in cyclohexane. The alloy specimen was cut in the prescribed length of several tens of centimeters. The specimen, was immersed in boiling 6N HCl for 7 to 10 days. The weight of the specimen before and after immersion was measured by using a microbalance. The loss of weight due to immersion was converted into the corrosion rate. The results are shown in Table 4.

Most of the amorphous alloys prepared in this example showed no detectable corrosion weight losses. After the immersion test, an X-ray photoelectron spectroscopy study of the alloy specimens immersed revealed the formation of passive tantalum oxyhydroxide [$TaO_2$(OH)] film or a passive mixed oxyhydroxide film consisting of $TaO_2$(OH) and $NbO_2$(OH) on the surfaces of the alloys, and the formation of these passive films is responsible for the high corrosion resistance of the alloys of this invention.

TABLE 3

| Relevant Embodiment No. | Sample No. | Compositions of Alloys (atomic %) Ni | Fe | Co | Ta | Nb | Ti | Zr | Cr | P |
|---|---|---|---|---|---|---|---|---|---|---|
| 1 | 1 | 70 | | | 30 | | | | | |
| 1 | 2 | 60 | | | 40 | | | | | |
| 1 | 3 | 50 | | | 50 | | | | | |
| 2 | 4 | 65 | | | 15 | 20 | | | | |
| 2 | 5 | 60 | | | 25 | 15 | | | | |
| 2 | 6 | 60 | | | 30 | 10 | | | | |
| 2 | 7 | 35 | | | 15 | 50 | | | | |
| 3 | 8 | 70 | | | 25 | | 5 | | | |
| 3 | 9 | 70 | | | 25 | | | 5 | | |
| 3 | 10 | 70 | | | 25 | | | | 5 | |
| 4 | 11 | 65 | | | 12 | 13 | 10 | | | |
| 7 | 12 | 4 | 36 | | 50 | | | | 10 | |
| 7 | 13 | 2 | | 38 | 50 | | | | 10 | |
| 7 | 14 | 4 | 10 | 21 | 55 | | | | 10 | |
| 8 | 15 | 2 | 28 | | 20 | 5 | | 45 | | |
| 9 | 16 | 75 | | | 20 | | | | | 5 |
| 10 | 17 | 78 | | | 7 | 13 | | | | 2 |
| 10 | 18 | 55 | | | 10 | 30 | | | | 5 |
| 11 | 19 | 55 | | | 20 | | 20 | | | 5 |
| 12 | 20 | 38 | | | 10 | 15 | 35 | | | 2 |
| 11 | 21 | 58 | | | 20 | | | 20 | | 2 |
| 12 | 22 | 50 | | | 20 | 5 | | | 20 | 5 |
| 12 | 23 | 78 | | | 7 | 9 | 5 | | | 1 |
| 12 | 24 | 77 | | | 7 | 9 | | 5 | | 2 |
| 12 | 25 | 77 | | | 7 | 9 | | | 5 | 2 |
| 15 | 26 | 4 | 34 | | 50 | | | | 10 | 2 |
| 14 | 27 | 2 | 20 | 16 | 20 | 40 | | | | 2 |
| 13 | 28 | 44 | | 15 | 40 | | | | | 1 |
| 16 | 29 | 54.5 | 5 | 5 | 10 | 20 | | 5 | | 0.5 |
| 16 | 30 | 39 | 10 | 10 | 20 | 10 | | | 10 | 1 |
| 16 | 31 | 38 | 10 | 10 | 10 | 15 | 5 | | 10 | 2 |
| 5 | 32 | 30 | 20 | 20 | 30 | | | | | |
| 5 | 33 | 30 | 10 | 20 | 40 | | | | | |
| 6 | 34 | 30 | 20 | 20 | 12 | 18 | | | | |
| 6 | 35 | 30 | 20 | 10 | 12 | 28 | | | | |

TABLE 4

Corrosion Rate of Alloys of the Invention

| Relevant Embodiment No. | Sample No. | Corrosion rate m per year |
|---|---|---|
| 1 | 1 | Not detected |
| 1 | 2 | Not detected |
| 1 | 3 | Not detected |
| 2 | 4 | Not detected |
| 2 | 5 | Not detected |
| 2 | 6 | Not detected |
| 2 | 7 | Not detected |
| 3 | 8 | 3 |
| 3 | 9 | 3 |
| 3 | 10 | 4 |
| 4 | 11 | Not detected |
| 7 | 12 | Not detected |
| 7 | 13 | Not detected |
| 7 | 14 | Not detected |
| 8 | 15 | Not detected |
| 9 | 16 | 1.3 |
| 10 | 17 | 1.0 |
| 10 | 18 | Not detected |
| 11 | 19 | 2.0 |

TABLE 4-continued

| Corrosion Rate of Alloys of the Invention | | |
|---|---|---|
| Relevant Embodiment No. | Sample No. | Corrosion rate m per year |
| 12 | 20 | Not detected |
| 11 | 21 | Not detected |
| 12 | 22 | Not detected |
| 12 | 23 | 1.5 |
| 12 | 24 | 1.0 |
| 12 | 25 | 2.5 |
| 15 | 26 | Not detected |
| 14 | 27 | Not detected |
| 13 | 28 | Not detected |
| 16 | 29 | Not detected |
| 16 | 30 | Not detected |
| 16 | 31 | Not detected |
| 5 | 32 | Not detected |
| 5 | 33 | Not detected |
| 6 | 34 | 3 |
| 6 | 35 | Not detected |

EXAMPLE 2

A variaty of alloy ingots were cast by argon arc melting of commercial metals and homo-made nickel phosphide. The cast alloys were remelted in an argon atmosphere and the molten alloys were rapidly solidified by the rotating wheel method shown in FIG. 1 to form ribbon-shaped amorphous alloys 0.01 to 0.05 mm thick, 1 to 3 mm wide, and 3 to 20 m long. The nominal compositions of the alloys are given in Table 5.

The formation of the amorphous structure was confirmed by X-ray diffractometry. Typical ones of the alloy samples were polished with silicon carbide paper up to #1000 in cyclohexane. The alloy specimen was cut in the prescribed length of several tens of centimeters. Then the specimen was immersed in boiling 6N HCl for 7 to 10 days. The weight of the specimen before and after immersion was measured by using a micro-balance. The loss of weight due to immersion was converted into the corrosion rate. The results are shown in Table 6.

Most of the amorphous alloys prepared in this example showed no detectable corrosion weight losses. After the immersion test an X-ray photoelectron spectroscopic study of the alloy specimens immersed revealed the formation of a passive tantalum oxyhydroxide [$TaO_2(OH)$] film or a passive mixed oxyhydroxide film consisting of $TaO_2(OH)$ and $NbO_2(OH)$ on the surfaces of the alloys, and the formation of these passive films is responsible for the high corrosion resistance of the alloys of this invention.

TABLE 5

| | | Compositions of Alloys (atomic %) | | | | | | | | | | | |
|---|---|---|---|---|---|---|---|---|---|---|---|---|---|
| Relevant Embodiment | Sample No. | Ni | Fe | Co | Ta | Nb | Ti | Zr | Cr | P | B | Si | C |
| 17 | 36 | 62 | | | 20 | | | | | 18 | | | |
| 17 | 37 | 55 | | | 25 | | | | | 20 | | | |
| 17 | 38 | 52 | | | 30 | | | | | 18 | | | |
| 17 | 39 | 42 | | | 40 | | | | | 18 | | | |
| 18 | 40 | 62 | | | 7 | 13 | | | | 18 | | | |
| 18 | 41 | 57 | | | 10 | 15 | | | | 18 | | | |
| 18 | 42 | 52 | | | 10 | 20 | | | | 18 | | | |
| 19 | 43 | 62 | | | 15 | | 5 | | | 18 | | | |
| 19 | 44 | 62 | | | 15 | | | 5 | | 18 | | | |
| 19 | 45 | 62 | | | 15 | | | | 5 | 18 | | | |
| 19 | 46 | 52 | | | 15 | | 15 | | | 18 | | | |
| 19 | 47 | 52 | | | 15 | | | 15 | | 18 | | | |
| 19 | 48 | 52 | | | 15 | | | | 15 | 18 | | | |
| 20 | 49 | 62 | | | 8 | 8 | | | 4 | 18 | | | |
| 20 | 50 | 51 | | | 8 | 8 | | 15 | | 18 | | | |
| 19 | 51 | 32 | | | 30 | | | | 20 | 18 | | | |
| 21 | 52 | 5 | 52 | | 25 | | | | | 18 | | | |
| 22 | 53 | 4 | | 53 | 10 | 15 | | | | 18 | | | |
| 18 | 54 | 43 | | | 7 | 40 | | | | 10 | | | |
| 25 | 55 | 58 | | | 30 | | | | | 10 | | 2 | |
| 26 | 56 | 39 | | | 10 | 30 | | | | 1 | 10 | 10 | |
| 27 | 57 | 40 | | | 30 | | 10 | | | 1 | 19 | 9 | |
| 28 | 58 | 40.95 | | | 10 | 20 | | 10 | | 0.05 | 10 | 9 | |
| 29 | 59 | 30 | 20 | | 30 | | | | | 7 | 10 | 3 | |
| 30 | 60 | 20 | | 20 | 20 | 20 | | | | 7 | 3 | 10 | |
| 31 | 61 | 20 | 10 | 10 | 20 | | 20 | | | 7 | 3 | 10 | |
| 31 | 62 | 20 | 10 | 10 | 20 | | | 20 | | 2 | 10 | 8 | |
| 31 | 63 | 2 | 38 | | 20 | | | | 20 | 2 | 10 | 8 | |
| 23 | 64 | 5 | 32 | 25 | 15 | | 5 | | | 18 | | | |
| 23 | 65 | 3 | 27 | 32 | 15 | | | 5 | | 18 | | | |
| 23 | 66 | 4 | 58 | | 15 | | | | 5 | 18 | | | |
| 24 | 67 | 4 | 22 | 30 | 8 | 16 | 5 | | | 15 | | | |
| 24 | 68 | 4 | 30 | 22 | 8 | 16 | | 5 | | 15 | | | |
| 24 | 69 | 4 | 30 | 22 | 8 | 16 | | | 5 | 15 | | | |
| 32 | 70 | 6 | 20 | 20 | 8 | 16 | 10 | | | 3 | 7 | 5 | 5 |
| 32 | 71 | 6 | 20 | 18 | 8 | 16 | | 10 | | 2 | 3 | 10 | 7 |
| 32 | 72 | 6 | 19 | 20.95 | 8 | 16 | | | 10 | 0.05 | 3 | 10 | 7 |

TABLE 6

| Corrosion Rate of Alloys of the Invention | | |
|---|---|---|
| Relevant Embodiment No. | Sample No. | Corrosion rate μm per year |
| 17 | 36 | 3 |
| 17 | 37 | 1.7 |
| 17 | 38 | Not detected |
| 17 | 39 | Not detected |
| 18 | 40 | 3.6 |
| 18 | 41 | 2 |
| 18 | 42 | Not detected |
| 19 | 43 | 5 |
| 19 | 44 | 4.3 |

TABLE 6-continued

| Corrosion Rate of Alloys of the Invention | | |
|---|---|---|
| Relevant Embodiment No. | Sample No. | Corrosion rate μm per year |
| 19 | 45 | 4 |
| 19 | 46 | 1.3 |
| 19 | 47 | Not detected |
| 19 | 48 | Not detected |
| 20 | 49 | Not detected |
| 21 | 50 | Not detected |
| 19 | 51 | Not detected |
| 21 | 41 | 1.5 |
| 22 | 53 | Not detected |
| 18 | 54 | Not detected |
| 25 | 55 | Not detected |
| 26 | 56 | Not detected |
| 27 | 57 | Not detected |
| 28 | 58 | Not detected |
| 29 | 59 | Not detected |
| 30 | 60 | Not detected |
| 31 | 61 | Not detected |
| 31 | 62 | Not detected |
| 31 | 63 | Not detected |
| 23 | 64 | 5.0 |
| 23 | 65 | 4.5 |
| 23 | 66 | 3.7 |
| 24 | 67 | Not detected |
| 24 | 68 | Not detected |
| 24 | 69 | Not detected |
| 32 | 70 | Not detected |
| 32 | 71 | Not detected |
| 32 | 72 | Not detected |

What is claimed is:

1. A method of preventing corrosion of a material against hot concentrated hydrochloric acids, comprising:

preparing an amorphous alloy consisting essentially of 30–80 atomic % of Ta, with the balance being substantially Ni, and contacting the amorphous alloy to the hot concentrated hydrochloric acids, said amorphous alloy forming a passive film in the acids to prevent corrosion.

2. A method according to claim 1, wherein said amorphous alloy is formed by sputter deposition.

3. A method according to claim 1, wherein said amorphous alloy further includes at least one of Fe and Co, Ni being 2 atomic % or more with the balance being substantially at least one of Fe and Co.

4. A method of preventing corrosion of a material against hot concentrated hydrochloric acids, comprising:

preparing an amorphous alloy consisting essentially of 7 atomic % or more of Ta, at least one of Nb, Ti, Zr and Cr in the amount up to 80 atomic % together with Ta, and Ni, and contacting the amorphous alloy to the hot concentrated hydrochloric acids, said amorphous alloy forming a passive film in the acids to prevent corrosion.

5. A method according to claim 4, wherein Ta is 12 atomic % or more, Nb being 30 to 80 atomic % together with Ta and the balance being substantially Ni.

6. A method according to claim 4, wherein Ta is 25 atomic % or more, at least one element selected from the group consisting of Ti, Zr and Cr being 30 to 80 atomic % together with Ta and the balance being substantially Ni.

7. A method according to claim 4, wherein Ta is 12 atomic % or more, Nb being 25 atomic % or more together with Ta, at least one element selected from the group consisting of Ti, Zr and Cr being 30 to 80 atomic % together with Ta and Nb, and the balance being substantially Ni.

8. A method according to claim 4, wherein said amorphous alloy further comprises at least one of Fe and Co, Ni being 2 atomic % or more with the balance being substantially at least one of Fe and Co.

9. A method according to claim 8, wherein Ta is 12 atomic % or more, Nb being 30 to 80 atomic % together with Ta.

10. A method according to claim 8, wherein Ta is 25 atomic % or more, at least one element selected from the group consisting of Ti, Zr and Cr being 30 to 80 atomic % together Ta.

11. A method according to claim 8, wherein Ta is 12 atomic % or more, Nb being 25 atomic % or more together with Ta, and at least one element selected from the group consisting of Ti, Zr and Cr being 30 to 80 atomic % together with Ta and Nb.

12. A method according to claim 4, wherein said amorphous alloy further includes P in the amount of 7 atomic % or less.

13. A method according to claim 12, wherein Ta is 7 atomic % or more, Nb being 20 to 80 atomic % together with Ta, and the balance being substantially 20 atomic % or more of Ni.

14. A method according to claim 12, wherein Ta is 15 atomic % or more, at least one element selected from the group consisting of Ti, Zr and Cr being 20 to 80 atomic % together with Ta, and the balance being substantially 20 atomic % or more of Ni.

15. A method according to claim 12, wherein Ta is 7 atomic % or more, Nb being 16 atomic % or more together with Ta, at least one element selected from the group consisting of Ti, Zr and Cr being 20 to 80 atomic % together with Ta and Nb, and the balance being substantially 20 atomic % or more of Ni.

16. A method according to claim 12, wherein said amorphous alloy further includes at least one of Fe and Co which is substantially the balance and is 20 atomic % or more together with Ni, and Ni being 2 atomic % or more.

17. A method according to claim 16, wherein Ta is 7 atomic % or more, and Nb being 20 to 80 atomic % together with Ta.

18. A method according to claim 16, wherein Ta is 15 atomic % or more, and at least one element selected from the group consisting of Ti, Zr and Cr being 20 to 80 atomic % together with Ta.

19. A method according to claim 16, wherein Ta is 7 atomic % or more, Nb being 16 atomic % or more together with Ta, and at least one element selected from the group consisting of Ti, Zr and Cr being 20 to 80 atomic % together with Ta and Nb.

20. A method of preventing corrosion of a material against hot concentrated hydrochloric acids, comprising:

preparing an amorphous alloy consisting essentially of 20 to 80 atomic % of Ta, 7 atomic % or less of P, and Ni, and contacting the amorphous alloy to the hot concentrated hydrochloric acids, said amorphous alloy forming a passive film in the acids to prevent corrosion.

21. A method according to claim 20, wherein said amorphous alloy further includes at least one of Fe and Co which is substantially the balance and is 20 atomic % or more together with Ni, and Ni being 2 atomic % or more.

22. A method of preventing corrosion of a material against hot concentrated hydrochloric acids, comprising:

preparing an amorphous alloy consisting essentially of 20 to 50 atomic % of Ta, and 10 to 23 atomic % of P with the balance being substantially Ni, and contacting the amorphous alloy to the hot concentrated hydrochloric acids, said amorphous alloy forming a passive film in the acids to prevent corrosion.

23. A method according to claim 22, wherein said amorphous alloy further includes at least one of Fe and Co, Ni being 2 atomic % or more with the balance being substantially at least one of Fe and Co.

24. A method of preventing corrosion of a material against hot concentrated hydrochloric acids, comprising:

preparing an amorphous alloy consisting essentially of 7 atomic % or more of Ta, at least one of Nb, Ti, Zr and Cr in the amount up to 50 atomic % together with Ta, 10 to 23 atomic % of P, and Ni, and contacting the amorphous alloy to the hot concentrated hydrochloric acids, said amorphous alloy forming a passive film in the acids to prevent corrosion.

25. A method according to claim 24, wherein Ta is 7 atomic % or more, Nb being 20 to 50 atomic % together with Ta and the balance being substantially Ni.

26. A method according to claim 24, wherein Ta is 15 atomic % or more, at least one element selected from the group consisting of Ti, Zr and Cr being 20 to 50 atomic % together with Ta and the balance being substantially Ni.

27. A method according to claim 24, wherein Ta is 8 atomic % or more, Nb being 16 atomic % or more together with Ta, at least one element selected from the group consisting of Ti, Zr and Cr being 20 to 50 atomic % together with Ta and Nb, and the balance being substantially Ni.

28. A method according to claim 24, wherein said amorphous alloy further includes at least one of Fe and Co, Ni being 2 atomic % or more with the balance being substantially at least one of Fe and Co.

29. A method according to claim 28, wherein Ta is 7 atomic % or more, and Nb being 20 to 50 atomic % together with Ta.

30. A method according to claim 28, wherein Ta is 15 atomic % or more, and at least one element selected from the group consisting of Ti, Zr and Cr being 20 to 50 atomic % together with Ta.

31. A method according to claim 28, wherein Ta is 8 atomic % or more, Nb being 16 atomic % or more together with Ta, and at least one element selected from the group consisting of Ti, Zr and Cr being 20 to 50 atomic % together with Ta and Nb.

32. A method of preventing corrosion of a material against hot concentrated hydrochloric acids, comprising:

preparing an amorphous alloy consisting essentially of 7 atomic % or more of Ta, at least one of Nb, Ti, Zr and Cr in the amount up to 50 atomic % together with Ta, 0.05 atomic % or more of P, at least one of B, Si and C in the amount of 10 to 23 atomic % together with P, and Ni, and contacting the amorphous alloy to the hot concentrated hydrochloric acids, said amorphous alloy forming a passive film in the acids to prevent corrosion.

33. A method according to claim 32, wherein Ta is 7 atomic % or more, Nb being 20 to 50 atomic % together with Ta, with the balance being substantially Ni.

34. A method according to claim 32, wherein Ta is 15 atomic % or more, at least one element selected from the group consisting of Ti, Zr and Cr being 20 to 50 atomic % together with Ta, with the balance being substantially Ni.

35. A method according to claim 32, wherein Ta is 8 atomic % or more, Nb being 16 atomic % or more together with Ta, at least one element selected from the group consisting of Ti, Zr and Cr being 20 to 50 atomic % together with Ta and Nb, with the balance being substantially Ni.

36. A method according to claim 32, wherein said amorphous alloy further includes at least one of Fe and Co, Ni being 2 atomic % or more with the balance being substantially at least one of Fe and Co.

37. A method according to claim 36, wherein Ta is 7 atomic % or more, and Nb being 20 to 50 atomic % together with Ta.

38. A method according to claim 36, wherein Ta is 15 atomic % or more, and at least one element selected from the group consisting of Ti, Zr and Cr being 20 to 50 atomic % together with Ta.

39. A method according to claim 36, wherein Ta is 8 atomic % or more, Nb being 16 atomic % or more together with Ta, and at least one element selected from the group consisting of Ti, Zr and Cr being 20 to 50 atomic % together with Ta and Nb.

40. A method of preventing corrosion of a material against hot concentrated hydrochloric acids, comprising:

preparing an amorphous alloy consisting essentially of 20 to 50 atomic % of Ta, 0.05 atomic % or more of P, at least one of B, Si and C in the amount of 10 to 23 atomic % together with P, and Ni, and contacting the amorphous alloy to the hot concentrated hydrochloric acids, said amorphous alloy forming a passive film in the acids to prevent corrosion.

41. A method according to claim 40, wherein said amorphous alloy further includes at least one of Fe and Co, Ni being 2 atomic % or more with the balance being substantially at least one of Fe and Co.

* * * * *